United States Patent [19]

Matsushiro

[11] 4,438,589

[45] Mar. 27, 1984

[54] MOVING TOY WITH MOVABLE BATTERY RECEPTACLE

[75] Inventor: Yukimitsu Matsushiro, Tokyo, Japan

[73] Assignee: Kabushiki Kaisha Matsushiro, Tokyo, Japan

[21] Appl. No.: 379,499

[22] Filed: May 18, 1982

[30] Foreign Application Priority Data

Mar. 9, 1982 [JP] Japan ..... 57-33100[U]

[51] Int. Cl.[3] ..... A63H 17/00

[52] U.S. Cl. ..... 46/251; 46/211

[58] Field of Search ..... 46/201, 206, 207, 209, 46/251, 254, 253, 248, 249, 45, 230, 211, 228, 202

[56] References Cited

U.S. PATENT DOCUMENTS 1,682,764 9/1928 Mohr ..... 46/211 X
3,708,913 1/1973 Terzian et al. ..... 46/251
3,772,824 11/1973 Terzian et al. ..... 46/206
3,785,086 1/1974 Escobedo ..... 46/251 X
4,329,810 5/1982 Terui ..... 46/206

*Primary Examiner*—Mickey Yu
*Attorney, Agent, or Firm*—Lane, Aitken & Kananen

[57] ABSTRACT

A moving toy having a front wheel and a rear wheel supported on a body and capable of operating in a normal mode with the front and rear wheels engaging the ground, and in a wheelie mode with the front wheels raised, having a battery in a battery receptacle for providing electric power to operate the toy. The center of gravity of the battery receptacle is located forward of the axle for the rear wheel when the toy is operating in the normal mode and rearward of the rear wheel when the toy is operating in the wheelie mode. The battery receptacle includes a spring biased stopper on a stop lever for engaging grooves on a surface of the vehicle body to retain the battery receptacle in a fore or an aft position, or in intermediate positions therebetween.

6 Claims, 4 Drawing Figures

MOVING TOY WITH MOVABLE BATTERY RECEPTACLE

BRACKGROUND OF THE INVENTION

The present invention relates generally to a moving toy which can operate in a normal mode and in a wheelie mode.

In a conventional moving toy, it is impossible to move in a wheelie mode, but rather to move only in a normal mode.

Namely, since the moving toy could not run on only the rear wheels with the front wheels raised by means of moving the center of gravity of the battery receptable to the rear of the axle of the rear wheels 4, it is impossible to provide a varied and interesting moving toy.

SUMMARY OF THE INVENTION

The object of the present invention is to provide a moving toy in which a battery receptacle is mounted so as to be movable forwardly or rearwardly along the rear portion of the body and which can change operation of the toy from a normal mode (FIG. 1), to a wheelie mode (FIG. 2) by shifting the battery receptacle.

BRIEF DESCRIPTION OF THE ACCOMPANYING DRAWINGS

The present invention will be understood more fully from the detailed description given herebelow and from the accompanying drawings of the preferred embodiment of the present invention, which, however, should not be taken as limitating the invention, but rather for elucidation and explanation only.

DESCRIPTION OF THE PREFERRED EMBODIMENTS

Referring now to the preferred embodiment of moving toy according to the present invention, the structure is illustrated hereinbelow with reference to the accompanying drawings.

Figure 1:
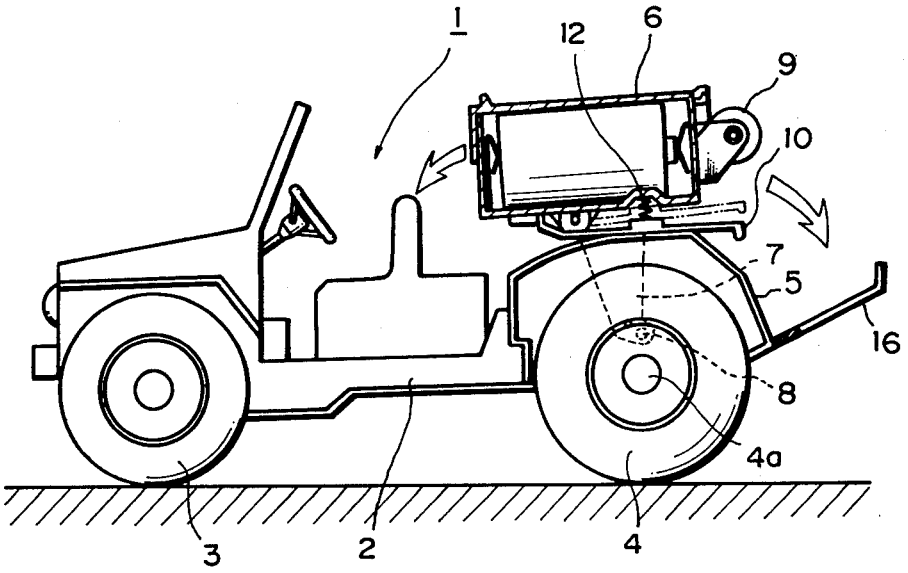
FIG. 1 illustrates a side view of a moving toy according to the present invention, including a partial sectional view thereof, shown in the normal mode.

FIG. 1 illustrates a moving toy according to the present invention. The numeral 2 designates a body modeled after an automobile. The lower portion of body 2 is provided with a pair of front wheels 3 and a pair of rear wheels 4. The rear wheels 4 are driven by an electric motor (not shown).

A battery receptacle 6 is mounted movably over a rear portion 5 of the body 2, the lower portion of which receptacle has a pair of right and left supporting arms 7. One end of each of the supporting arms 7 is respectively mounted to two pivots 8 located parallel to an axle **4*a* for the rear wheels 4**.

The battery receptacle 6 accommodates a battery which furnishes the electric motor with electric energy necessary to operate the toy.

The battery receptacle 6 is provided with an auxiliary wheel 9 which rolls along the ground to stabilize the toy during the so-called wheelie mode in which the toy runs on only the rear wheels 4 with the front wheels 3 raised.

Figure 4:
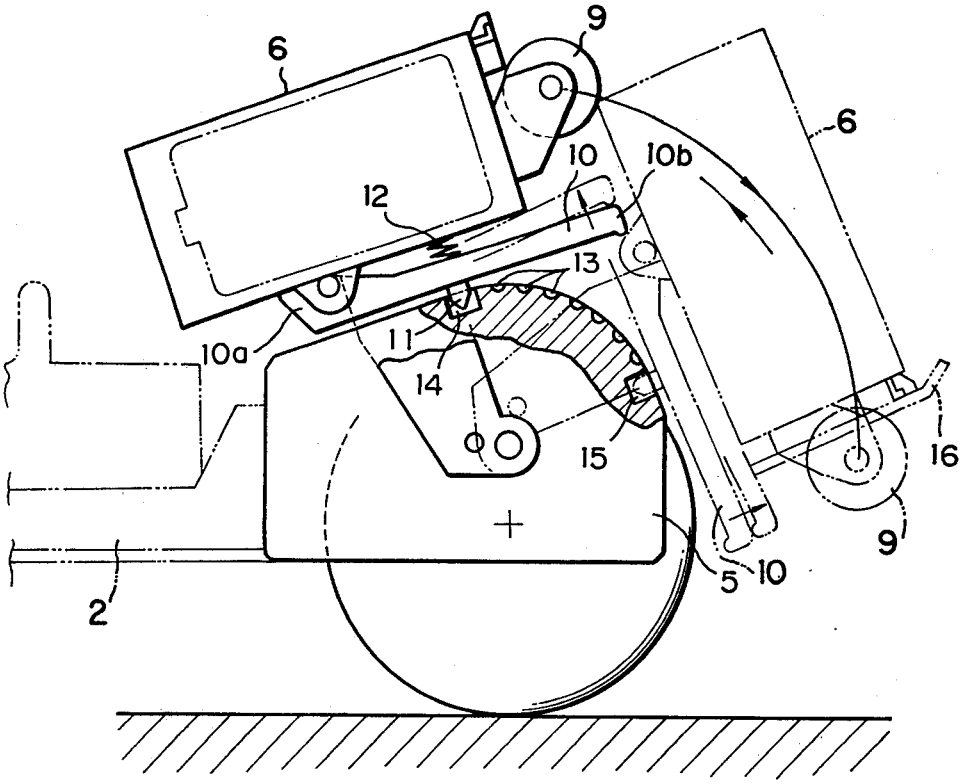
FIG. 4 illustrates the fixture and movement of the battery receptacle.

On the other hand, the battery receptacle 6 is provided with a stop lever 10 which allows the battery receptacle 6 to pivot and be supported at any angle of inclination. In detail as best seen in FIG. 4, the stop lever 10 is pivotably supported at one end **10*a* by the bottom of the battery receptacle 6, and the free end 10*b* projects to the rear of the rear portion 5 of the body 2. The intermediate portion of the stop lever 10 is provided with a downward projecting stopper 11. The stopper 11 is urged into contact with the rear portion 5 of the body by a spring 12 positioned between the battery receptacle 6 and the stop lever 10**.

Grooves 13 are provided within the fixed range of movement of the above stopper 11, on the surface of the rear portion 5 of the body 2. Furthermore, there is a front groove 14 in the front part of the rear portion 5 of the body and a rear groove 15 in the rear part thereof in front of and behind the grooves 13, respectively the grooves 14 and 15 being slightly deeper than the grooves 13.

While the above battery receptacle 6 is movable longitudinally by pivotable means, a rail may be provided along the body 2 to enable the battery receptacle 6 to shift therealong.

The operation of the moving toy 1 constructed as above will be explained below.

When the normal mode is desired, the battery receptacle 6 is advanced counter-clockwise as shown in FIG. 4, to be positioned at its foremost position with respect to the body 2 as shown in solid lines. In this case, the stopper 11 of the stop lever 10 is inserted in the front groove 14, so that the center of gravity of the battery receptacle 6 will be forward of the axle **4*a* of the rear wheels 4. Therefore, the front wheel 3 and the rear wheels 4 support the body 2 on the ground to enable the toy 1 to operate in the normal mode as shown in FIG. 1**.

Figure 2:
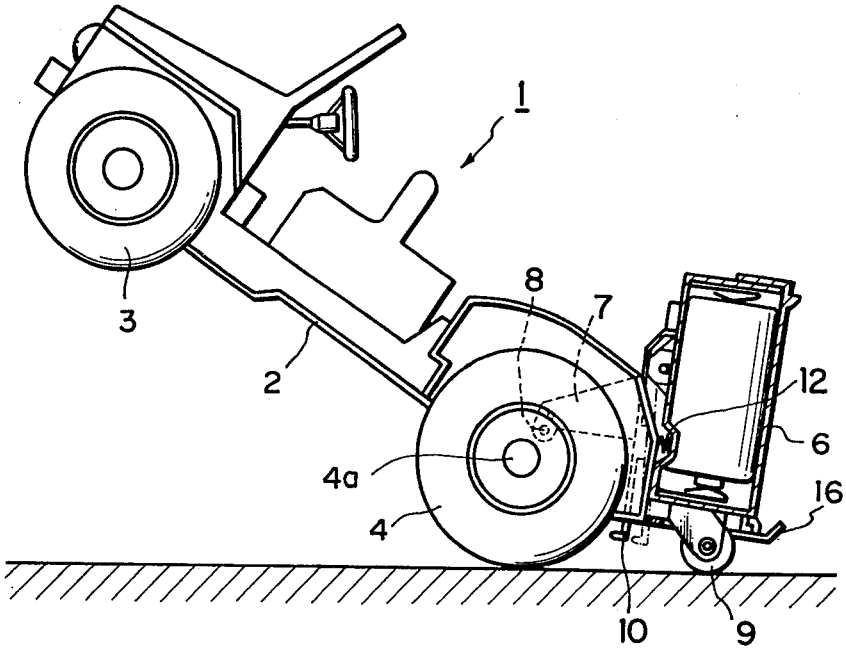
FIG. 2 illustrates a side view of the abovementioned toy, including a partial sectional view thereof, shown in the wheelie mode.
Figure 3:
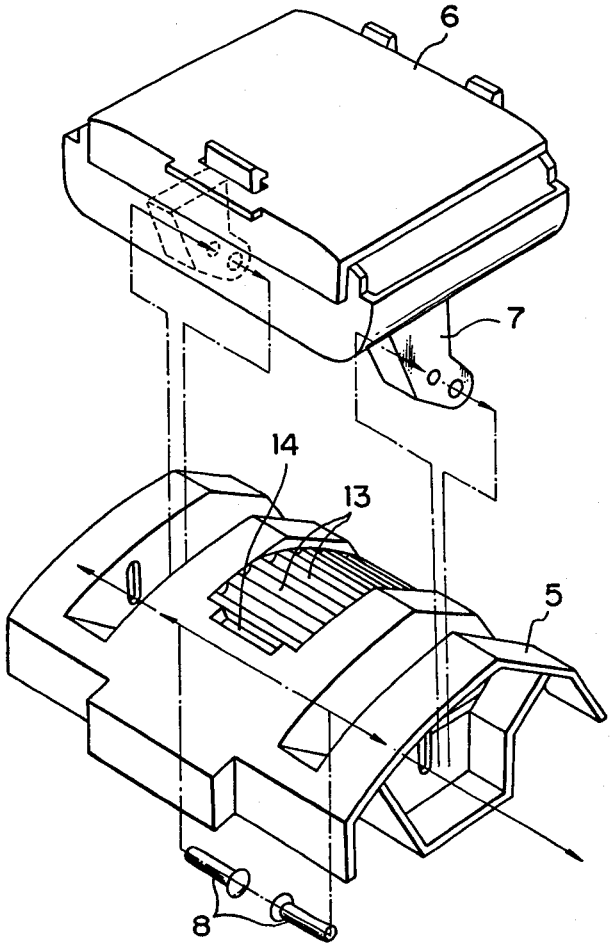
FIG. 3 illustrates an exploded perspective view of a rear portion of the body and a battery receptacle.

When the wheelie mode is desired, the free end **10*b* of the stop lever 10 is raised to enable the stopper 11 to disengage from the front groove 14. Then the battery receptacle 6 is turned clockwise to the position as shown in phantom lines in FIG. 4. In this case, the stopper 11 is inserted in the rear groove 15, so that the center of gravity of the battery receptacle 6 will be to the rear of the axle 4*a* of the rear wheels 4 to raise the front wheels 3, as shown in FIG. 2, with the auxiliary wheel 9, being closed on the ground. Therefore, the rear wheels 4 and the auxiliary wheel 9 on the ground enable the moving toy 1 to operate in wheelie mode as shown in FIG. 2**.

Different batteries have different weights, so the stopper 11 may be inserted into whichever of the grooves 13 is appropriate. A nature of a moving toy 1 according to the present invention includes any model having wheels such as a motorcycle model in addition to the above-mentioned automobile model.

In the embodiment set forth above, a stopper 16 may be provided in a rear part of the rear portion 5 of the body, as shown in FIGS. 1 and 2, to limit the angular range of the battery receptacle 6 to within a fixed range. As mentioned above, a moving toy according to the present invention provides a battery receptacle for shifting the center of gravity of the toy being movable along the longitudinal axis of the body. Such shifting of the battery receptacle enables the toy to operate either in a normal mode or a wheelie mode.

What is claimed is:

1. A moving toy having a body, a battery receptacle, and movable means for shifting the center of gravity of the toy by shifting the position of the battery receptacle relative to the body, comprising:

a stop lever which allows the battery receptacle to pivot and be supported at any angle of inclination, a downward projecting stopper which is provided on an intermediate portion of the stop lever, a spring positioned between the battery receptacle and the stop lever for the purpose of urging the stop lever into contact with a rear portion of the body, a groove provided within the fixed range of movement of the stopper, located on a surface of a rear portion of the body, and a front groove in a front part of the rear portion of the body and rear groove in a rear part thereof, each being slightly deeper than the first-mentioned groove.

2. A moving toy having a battery receptacle according to claim 1, wherein said movable means for shifting the center of gravity of the toy includes rail means provided along the body to enable the battery receptacle to shift therealong.

3. A moving toy of the type which includes at least a front wheel and a rear wheel; a body supporting said front wheel and said rear wheel in a normal mode engaging the ground; a battery receptacle for receiving a battery for providing electric power to operate the toy, the center of gravity of said battery receptacle with said battery being located forward of an axle for said rear wheel when the toy is operating in the normal mode, the improvement comprising means for operating the toy in a wheelie mode wherein said front wheel is disengaged from the ground, said wheelie mode operating means including:

means for pivoting said battery receptacle between a first position at a first location wherein the toy operates in the normal mode and a second position at a second location wherein said toy operates in a wheelie mode, said means including a stop lever on said battery receptacle which allows the battery receptacle to pivot between said first position and said second position;

a projecting stopper on said stop lever for engaging a portion of the body of the vehicle to retain said battery receptacle in at least said first position and said second position;

means for biasing said projecting stopper into engagement with said vehicle body whereby, when the projecting stopper engages the vehicle body to retain the battery receptacle in said first position, the center of gravity of the battery receptacle is forward of the axle of the rear wheel, and when the projecting stopper engages the vehicle body to retain the battery receptacle in the second position, the center of gravity of the battery receptacle is rearward of the axle of the rear wheel thereby to cause operation of the toy in the wheelie mode.

4. The moving toy as set forth in claim 3 wherein said portion of said vehicle body includes a plurality of grooves for engaging said projecting stopper on said stop lever to permit the battery receptacle to be positioned in any one of a plurality of positions intermediate said first position and said second position.

5. The moving toy as set forth in claim 4 wherein said plurality of grooves include a front groove in the front part of the rear portion of the vehicle body and a rear groove in the rear part of the rear portion of the body, said rear groove being slightly deeper than said intermediate grooves, said front groove fixing the position of said battery receptacle in said first position, and said rear groove fixing the position of said battery receptacle in said second position.

6. The moving toy as set forth in claim 3, further including an auxiliary wheel for engaging the ground when said toy is in a wheelie mode.

* * * * *